United States Patent [19]

Sorensen

[11] 4,274,416

[45] Jun. 23, 1981

[54] METHOD OF USING A GUIDE FOR REPLACEMENT OF EARRINGS IN PIERCED EARS

[76] Inventor: David J. Sorensen, 1012 NE. Knoles Dr., Vancouver, Wash. 98665

[21] Appl. No.: 95,974

[22] Filed: Nov. 20, 1979

Related U.S. Application Data

[62] Division of Ser. No. 901,181, Apr. 28, 1978, abandoned.

[51] Int. Cl.[3] ..... A61B 17/00

[52] U.S. Cl. ..... 128/330

[58] Field of Search ..... 128/330, 329 R, 343; 63/12, 13; 40/300, 301

[56] References Cited

U.S. PATENT DOCUMENTS

| | | | |
|---|---|---|---|
| 113,031 | 3/1871 | Edge | 128/329 R |
| 161,853 | 4/1875 | Baker | 63/12 |
| 360,423 | 4/1887 | Edge | 63/12 |
| 2,568,207 | 9/1951 | Spicher | 63/12 X |
| 3,527,223 | 9/1970 | Shein | 128/330 |
| 4,067,341 | 1/1978 | Ivey | 128/330 |

FOREIGN PATENT DOCUMENTS

| | | | |
|---|---|---|---|
| 98330 | 7/1898 | Fed. Rep. of Germany | 63/13 |
| 1247653 | 9/1971 | United Kingdom | 128/330 |

*Primary Examiner*—Kyle L. Howell
*Assistant Examiner*—Michael H. Thaler
*Attorney, Agent, or Firm*—Chernoff & Vilhauer

[57] ABSTRACT

A guide for replacement of stud type earrings is comprised of an elongate thin walled tubular rod having an inside diameter which loosely receives the stud of an earring, and having a grip at one end which defines a conical reservoir for carrying a measured amount of antiseptic fluid which is ejected along the rod and over the earring stud. A positioner having a medial opening which interconnects with a conical locating depression, fits over the rod to assist the user in aligning the rod with the extremity of the stud which protrudes from the wearer's ear. The method by which the guide is used comprises placing the rod over the protruding extremity of the earring stud, with its clasp removed, and then forcing it inwardly over the stud and through the opening in the ear. The rod then defines the opening so that the earring can be removed and replaced without any danger of damage to the ear. After the replacement earring is in place the antiseptic is ejected along the rod and over the stud to disinfect it, the guide is removed from the ear and the clasp is reinstalled onto the stud.

4 Claims, 11 Drawing Figures

METHOD OF USING A GUIDE FOR REPLACEMENT OF EARRINGS IN PIERCED EARS

This is a division, of application Ser. No. 901,181 filed Apr. 28, 1978 now abandoned.

BACKGROUND OF THE INVENTION

This invention relates to a guide for use in replacement of earrings in pierced ears, and to the method by which said guide is used.

Ears are commonly pierced for earrings by driving the pointed stud of an earring through the ear lobe. However, the earring must then be left in place for a considerable length of time to allow the opening thus formed to heal into a permanent passageway. Otherwise, once the stud is removed, the tissue which surrounds it closes back into the opening making it quite difficult to relocate the opening when the earring is reinstalled. When this happens often the tissue surrounding the opening is damaged by the earring as it is reinstalled, or, in some instances, an entirely new opening must be formed in order to reinsert the stud. In either event there is an increased chance of infection developing, and in the latter case the opening may become seriously skewed since the user generally does not have a piercing tool which inserts the earring into the ear in the correct orientation.

However, it is often desirable, if not necessary, to remove the original earring before the opening has fully healed into a permanent passageway. Beside the normal desire of the user to replace the rather plain earrings used for piercing with aesthetically more pleasing ones, even when the original earrings are not disturbed, there is a good possibility that infection may set in in spite of anti-infective measures being taken. When this happens, while removal and replacement of the earring becomes necessary, it is counterproductive due to the likelihood of the above-described damage occuring to tissue which may introduce further infection. This is particularly true when the user has a difficult time inserting the stud back into the original unformed opening, since she necessarily touches the stem in the process thereby contaminating it.

Accordingly, many people must abandoned their desire to wear pierced earrings after the initial piercing due to the difficulties associated with forming of the opening.

SUMMARY OF THE INVENTION

The guide of the present invention overcomes the aforementioned shortcomings and disadvantages of pierced earrings by providing a channel which extends through the opening in the ear so that after removal the stud of the earring can be reinserted through the guide rather than requiring that it be inserted through the opening itself.

The guide comprises an elongate thin walled tubular rod having an inside diameter which is sized to receive the stud of the earring. The distal extremity of the rod is contoured to facilitate its entry into the opening in the ear lobe without injuring the surrounding tissue, and the other extremity of the rod contains a handle by which the user manipulates the guide. The handle comprises a cylindrical grip which has a medial bore extending longitudinally through it and a conical reservoir, for carrying an antiseptic fluid, which interconnects with the rod.

Associated with the guide is a positioner through which the guide slidingly fits, having an outwardly flared depression located at one end. Therefore, as the depression is placed over the portion of the earring stud which extends outwardly from the ear the positioner becomes centered on it, coaxially aligning the rod and the stud.

In use after removing the clasp from the earring both the depression in the positioner and the reservoir in the handle are filled with an antiseptic fluid, and the depression, and thus the end of the rod, is placed over the outwardly extending portion of the earring. Thereafter the guide is shoved inwardly so that the rod completely passes over the stud and through the opening in the ear. The earring can then be removed freely and a new earring placed into the rod without ever coming into contact with the opening. The antiseptic fluid is ejected from the reservoir down the rod by placing the user's finger over the reservoir thereby disinfecting the stud of the new earring. The guide is then removed by pulling it back off the stud of the new earring and the clasp is installed onto the earring.

Accordingly, it is a principal object of the present invention to provide a guide which is easily installed through a pierced ear opening over the top of the earring stud to allow removal and replacement of the earring without damaging tissue surrounding the opening.

It is a further object of the present invention to provide such a guide which has means to eject an antiseptic solution along the new earring stud after it is inserted into the ear.

It is a further object of the present invention to provide a positioner which aids in the insertion of the guide onto the stud of the earring.

It is a further object of the invention to provide such a positioner which has means to apply an antiseptic fluid to the rod as it is inserted into the opening in the ear.

It is a further object of the invention to provide such a guide and a positioner which are inexpensive to manufacture and of simplified construction for ease in use.

The foregoing objects, features and advantages of the present invention will be more readily understood upon consideration of the following detailed description of the invention taken in conjunction with the accompanying drawings.

DETAILED DESCRIPTION OF THE INVENTION

Figure 1:
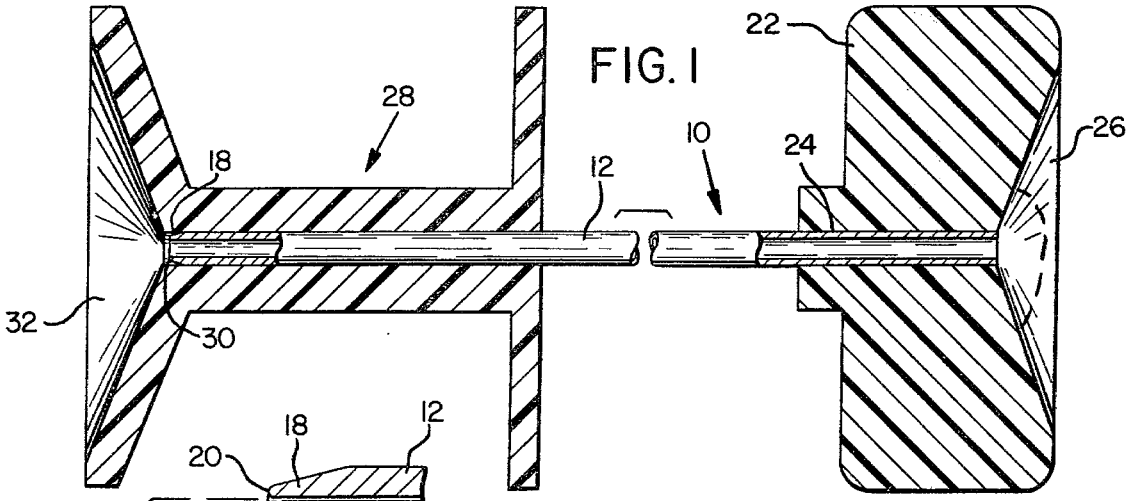
FIG. 1 is a foreshortened cross sectional view showing a preferred embodiment of the guide of the present invention.

Referring to FIG. 1 of the drawings, the guide 10 of the present invention includes an elongate thin walled tubular rod 12 having an inside diameter which loosely receives the stud 14 of an earring 16. Preferably the rod 12 is made from a non-corrosive metal such as stainless steel which is easy to sterilize during use.

Figure 2:
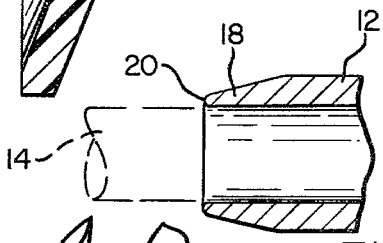
FIG. 2 is a fragmentary detailed view showing a portion of the guide of FIG. 1.
Figure 3:
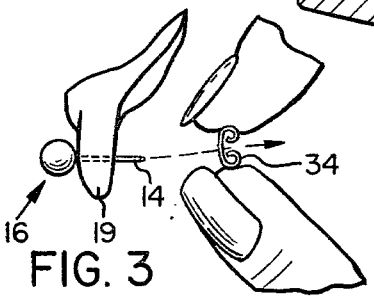
FIGS. 3–11 are a sequence of views showing the method by which the invention is used.

The distal extremity 18 of the rod, FIG. 2, is contoured to facilitate its entry into the opening in the ear lobe 19. To this end, in the embodiment illustrated, the outer wall of the extremity 18 is angled inwardly toward the inner wall at a 10–15 degree angle, and the respective walls do not meet in a sharp edge but are interconnected by a blunt arcuate tip 20.

Handle means are attached to the other extremity of the rod 12 to aid the user in manipulating the guide and inserting it into the opening in the ear. The handle means comprises a cylindrical grip 22 having a medial bore 24 extending longitudinally through it with the end of the rod 12 being press-fit partially into the bore 24. Radiating outwardly from the bore, on the side of the grip opposite rod 12, is a conical reservoir 26.

Associated with the guide 10 is positioner means 28 which aids the user to align the rod 12 with the stud 14 when the guide is placed in the ear. The positioner means has a length which is less than the length of the rod by an amount greater than the thickness of the ear lobe and it has a medial opening 30 passing through it which is arranged to loosely receive the rod. One end of the positioner means has a medial depression 32 which flares outwardly from opening 30. Therefore, when the positioner means is placed into contact with the stud 14, the depression 32 serves to center the stud and bring it into alignment with the rod.

The method by which the above-described guide is used in replacing an earring is shown sequentially in FIGS. 3–11. The clasp 34 is removed from the earring 16 which is already in place in the ear lobe 19, FIG. 3. While the guide is most essential in connection with newly pierced ears where the opening is not completely formed, it is also beneficial in other situations, since removal of the small diameter stud always allows the surrounding tissues to expand thereby at least obscuring if not reclosing the opening.

Figure 4:
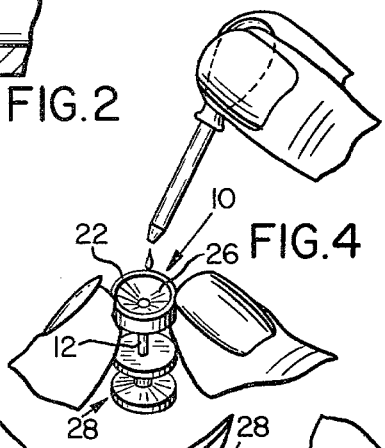

Referring to FIG. 4, the guide is prepared for use by installing positioning means 28 onto it, with rod 12 extending through opening 30 until its tip 20 lies flush with the inner margin of the depression 32. Thereafter resevoir 26, in grip 22, and depression 32, in positioning means 28, are filled with an antiseptic solution, such as alcohol. It will be noted that since the portion of rod 12 which passes through the opening in the ear must first pass through the depression in the positioner, and thus the alcohol, the rod becomes disinfected at a point after which it will no longer be handled by the user.

Figure 5:
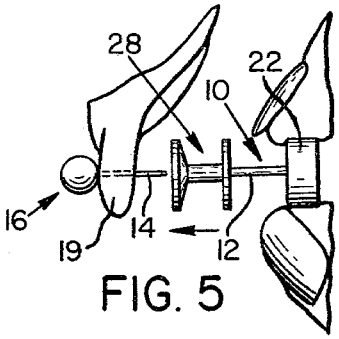
Figure 6:
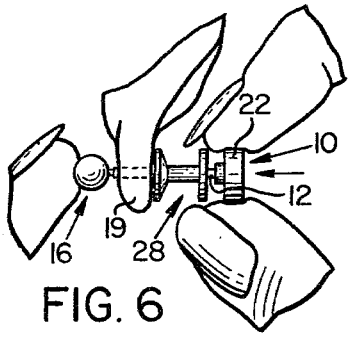
Figure 7:
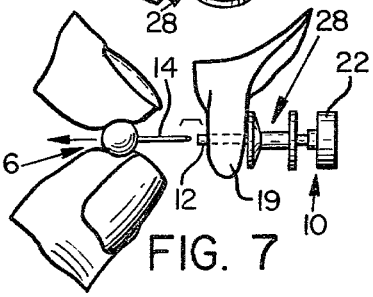
Figure 8:
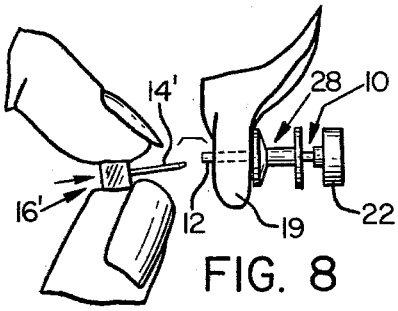

The guide is then inserted onto the portion of the stud 14 which projects from the ear lobe, FIG. 5, with the depression 32 serving to align the rod 10 and stud 14, even though the user normally does not have visual access to these elements. As shown in FIG. 6, the guide is then directed over the stud through the opening in the ear. The tapered extremity 18 of the rod allows it to be readily inserted into the opening and the blunt rounded tip 20 prevents it from catching or cutting the surrounding tissue. Since the stud remains in place it serves to keep the opening from becoming closed and defines a path through which the rod is inserted. The earring 16 then can be removed from the rod, FIG. 7, and a new earring 16' easily inserted, FIG. 8, without the necessity of forcing the new stud 14' through collapsed tissue. Thus stud 14' is directed through the exact same opening as stud 14 was, thereby speeding the healing of the opening along a single, well defined path. Also the tissue surrounding the opening is not punctured to allow entry of infections organisms.

Figure 9:
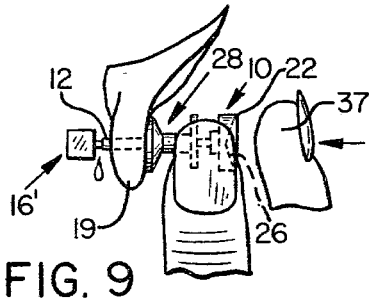

The new stud is then disinfected, FIG. 9, by placing one of the user's fingers 37 over reservoir 36 thereby forcing the small amount of antiseptic located in the resevoir down the length of the rod 10 over stud 14'. It will be noted that due to the configuration of the guide only a small amount of antiseptic is ejected and it is done so at a low pressure rather than being squirted as would occur with an aspirator bulb.

Figure 10:
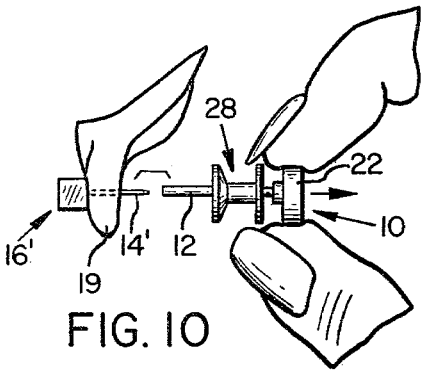
Figure 11:
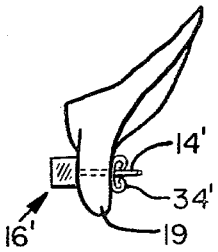

The guide is then removed, FIG. 10, and the clip 34' is installed to secure the new earring in position, FIG. 11. In addition to being itself disinfected and disinfecting the earring, the rod serves to scrape accumulated material from the opening thereby cleaning the opening of undesirable contamminants which is desirable even in a fully healed ear. Therefore, the guide further serves to promote a single well defined opening.

While the positioner means 28 greatly facilitates the insertion of rod 12, it will be understood that it is not essential and that the guide can also be used without the addition of the positioner means.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. The method of removing and reinstalling a stud type earring in a pierced ear comprising:

(a) placing over the exposed extremity of the stud of the earring, which is in place in an opening in the ear and has its clasp removed, a guide having an elongate tubular rod with an inside diameter arranged to loosely receive said stud;

(b) forcing said guide completely over the stud and through the opening in the ear;

(c) thereafter removing the earring from said guide and the ear leaving said guide in place in the ear;

(d) reinserting said stud into said rod and back through the opening;

(e) removing said guide from the opening leaving said stud located therein; and (f) placing said clasp back onto said stud.

2. The method of claim 1 including the additional steps of:

(a) placing an antiseptic solution in a reservoir which is interconnected to said rod before placing said rod over the extremity of said stud; and (b) ejecting said antiseptic solution from said reservoir through said rod after reinserting said stud back through said opening.

3. The method of claim 1 including the further step of placing a positioner, having an outwardly flared depression, over said rod prior to placing said rod over said stud to aid in positioning said rod coaxially with said stud.

4. The method of claim 3 including the further step of placing an antiseptic solution into said flared depression before placing said positioner over said rod so that said rod passes through said antiseptic solution to be disinfected as it is forced through the opening in said ear.

* * * * *